US007992812B2

(12) United States Patent
Doppstadt et al.

(10) Patent No.: US 7,992,812 B2
(45) Date of Patent: Aug. 9, 2011

(54) SCREENING DEVICE

(75) Inventors: Johann Doppstadt, Velbert (DE); Horst Berger, Calbe/Saale (DE)

(73) Assignee: Doppstadt Calbe GmbH, Calbe/Saale (DE)

( * ) Notice: Subject to any disclaimer, the term of this patent is extended or adjusted under 35 U.S.C. 154(b) by 358 days.

(21) Appl. No.: 11/921,765

(22) PCT Filed: Jun. 7, 2006

(86) PCT No.: PCT/EP2006/005419

§ 371 (c)(1),
(2), (4) Date: Dec. 7, 2007

(87) PCT Pub. No.: WO2006/131333

PCT Pub. Date: Dec. 14, 2006

(65) Prior Publication Data

US 2009/0145812 A1 Jun. 11, 2009

(30) Foreign Application Priority Data

Jun. 8, 2005 (DE) ..... 20 2005 009 043 U
Mar. 3, 2006 (DE) ..... 20 2006 003 533 U

(51) Int. Cl.
*B02C 18/16* (2006.01)

(52) U.S. Cl. ..... 241/73; 209/660

(58) Field of Classification Search ..... 241/73, 241/189.1; 209/660, 675, 393, 668, 674, 209/676, 394, 615, 616
See application file for complete search history.

(56) References Cited

U.S. PATENT DOCUMENTS

| | | | | |
|---|---|---|---|---|
| 2,003,522 | A * | 6/1935 | Thoen | 460/109 |
| 2,324,382 | A * | 7/1943 | Goodwin | 99/571 |
| 6,079,647 | A * | 6/2000 | Leduc et al. | 241/73 |
| 7,909,277 | B2 * | 3/2011 | Doppstadt et al. | 241/73 |

FOREIGN PATENT DOCUMENTS

| | | |
|---|---|---|
| AT | 140729 | 2/1985 |
| DE | 805 956 B | 6/1951 |
| DE | B23056 III/50D | 3/1956 |
| DE | 944 481 B | 6/1956 |
| DE | 18 58 520 U | 7/1962 |
| GB | 230632 | 3/1925 |
| GB | 687499 | 2/1953 |
| JP | 07-284730 | 10/1995 |
| WO | WO 92/10312 | 6/1992 |

OTHER PUBLICATIONS

German search report dated May 16, 2006.
International search report dated Feb. 9, 2007.

* cited by examiner

*Primary Examiner* — Faye Francis
(74) *Attorney, Agent, or Firm* — Jacobson Holman PLLC

(57) ABSTRACT

A sieve device including a cog elongation with several cogs shaped from flexible material arranged parallel to each other. The cogs are provided with bends or chamfers serving for defining a grid to define the grain size for the sieved material. The sieve device is included in a cylinder disintegrator.

17 Claims, 3 Drawing Sheets

Figure 1:
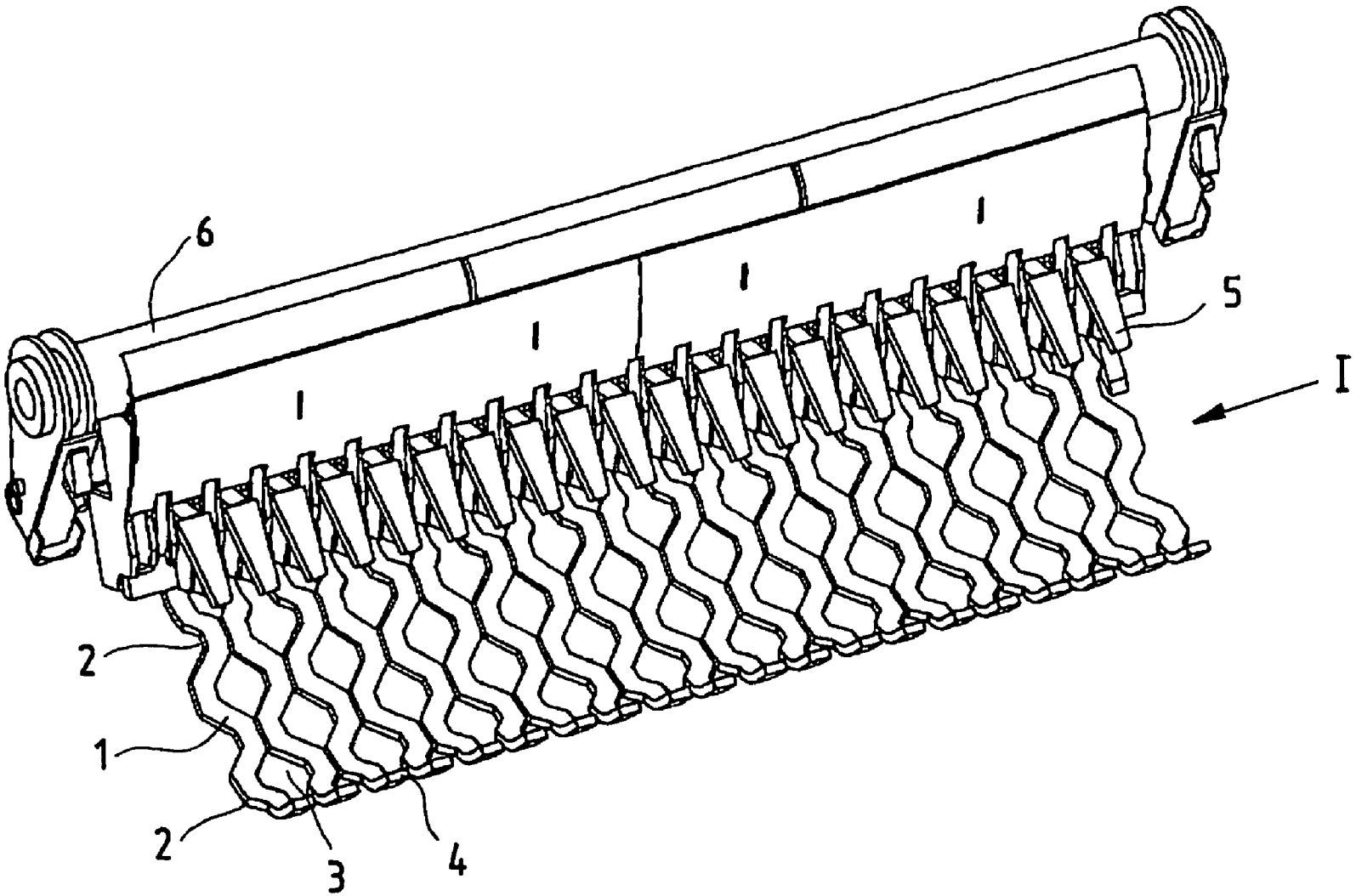

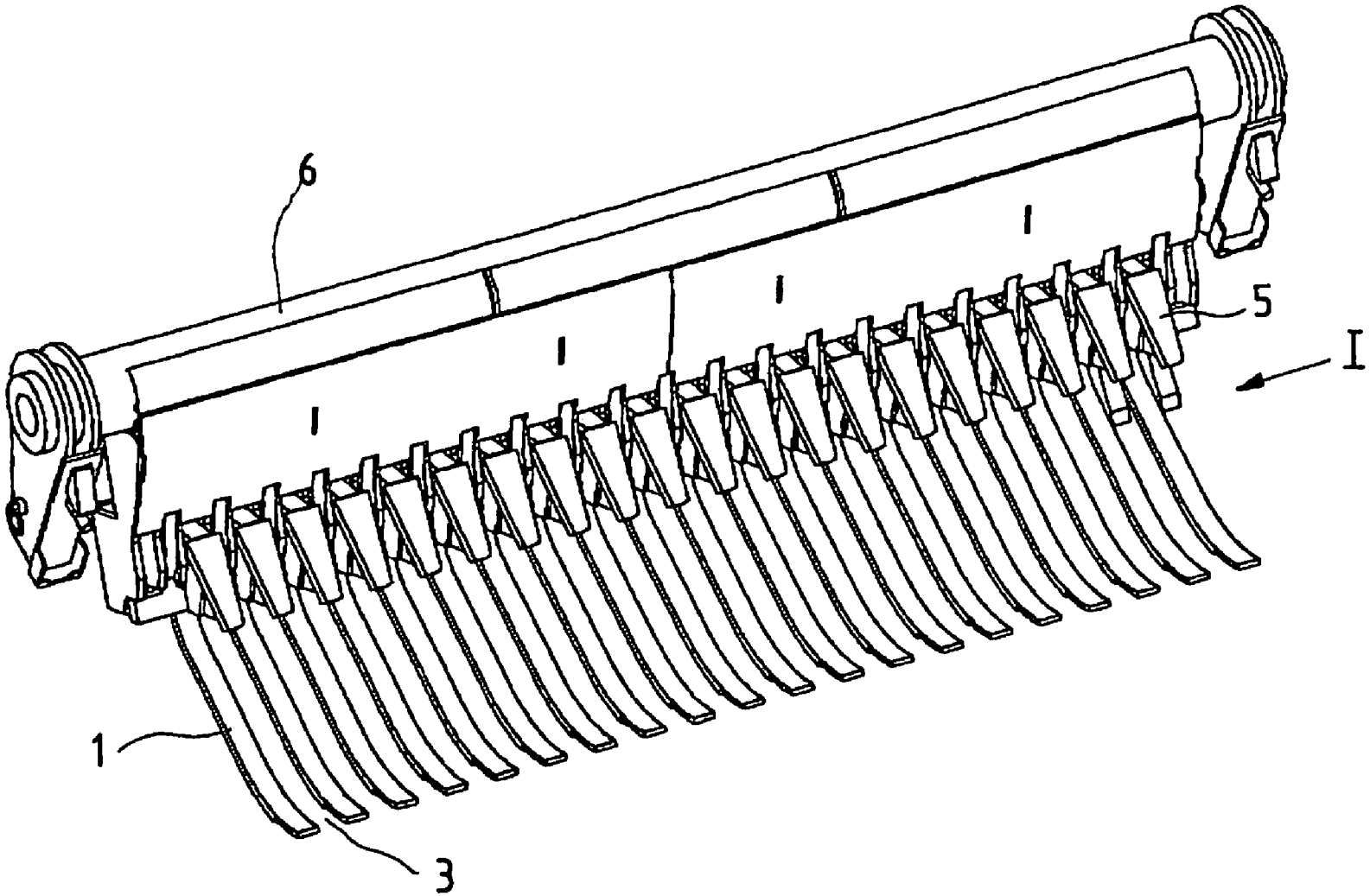
Fig.3 (St.d.T.)

SCREENING DEVICE

This is a national stage of International Application No. PCT/EP2006/005419 filed on Jun. 7, 2006 and published in German.

DESCRIPTION

The invention refers to a sieve device comprising a cog elongation with several cogs shaped from flexible material arranged parallel to each other.

Sieve devices of this type are known, they are used, for example, with cylinder disintegrators which are used for comminuting garbage, bulky refuse, old wood and so on. The cylinder disintegrators here have teeth which work against a countercog and thus comminute the material.

In order to reach a certain grain size baskets with a certain perforation are arranged below the disintegration cylinder. These baskets are arranged in general fixedly. The size and type of perforation determines the grain size of the final material. The application of the fixed baskets makes the cylinder disintegrators prone to disturbances of, for example, stones, iron parts and so on. Large parts which have not been comminuted and do not pass through the basket are revolved again and again around the cylinder and thus can damage the cutters or cutting tools or the basket. At a micro-comminuting with a basket perforation of 20 mm to about 80 mm and a rotary frequency of the cylinder of about 100 revolutions per minute it is thus absolutely necessary to supply the starting material without disturbing material for comminuting. This means that this material has to be pre-treated. This operation is relatively expensive as this pre-grading or pre-treating requires the use of additional machines and additional working time.

In the pre-comminuting of material, where generally untreated material has to be comminuted, however, also an exact comminuting of the material is desired. For example, here a grain size of less than 150 mm is provided. The use of a fixed basket is here, because of the reasons mentioned above, very problematic or even impossible.

For this reason so far also sieve devices have been used which have a so-called even cog elongation in order to remove the comminuted material by sieving, and to guide again material which has not been comminuted in the disintegration process across the cylinder. The advantage of this solution known from the state of the art compared with the fixed basket is the fact that the individual cogs of the cog elongation are movable in a certain way and thus are able to get out of the way when non-comminuted material pass through the cog. This means that the cog can get out of the way when very large parts, like iron parts, get in the funnel. The individual cogs of the cog elongation can be exchanged here quite easily when damaged.

The disadvantage of the even rods is the fact that thin and long material can drop through the gaps between the cogs and thus the desired grain accuracy cannot be reached.

Therefore it is an object of the invention to suggest a sieve device which does not have anymore the disadvantages of the state of the art described before.

The invention comes from the state of the art described before, and suggests a sieve device comprising a cog elongation with several cogs shaped from flexible material arranged parallel to each other which is characterised in that the cogs are provided with bends or chamfers serving for defining a grid for defining the grain size for the sieved material. Because of this solution it is now possible to form a certain grid for defining the grain size, and thus to reach a quite good accuracy and precision of disintegration of the material to be comminuted. The advantages of the sieve devices working with a so-called even cog elongation remain here, namely in that respect that the cogs are flexible in a certain way. They are shaped preferably from spring material, for example spring steel. Very large disturbing parts, for example iron parts, which are not comminuted by the cylinder disintegrator can be guided because of this flexible design of the cogs of the cog elongations through the cog without any problems. At the same time, however, over sizes of grain which drop through the gaps with even cog elongations are prevented from dropping through the cog elongation, and thus are guided again to the disintegration. This design of the sieve device according to the invention achieves that the susceptance to failure of the sieve device or the cylinder disintegrator itself is reduced. Furthermore the definition of the grain sizes which have to be sieved is improved further, and the sieved material comes in a quite accurate grain size. Over sizes can be removed without any problems also by machines when the sieved good is transported away. This is done in the usual manner, for example, in magnetic separators, manually or by means of other technically suited means.

A convenient development of the invention is characterised by the fact that the cogs have trapezoidal bends. By means of these trapezoidal bends a honey-combed grid is formed which makes a very good definition of the required sieve size for the comminuted material possible. Furthermore, the distances between the single cogs can vary so that larger and smaller grids result. It is also possible to exchange the cogs of the cog elongation, and thus to effect a larger grid. Of course, for that purpose also the complete cog elongation with different cog designs can be stored.

A development of the invention provides that the bends are bent in opposite direction so that the grid is defined as the honey-combed sieve already described. Furthermore, an embodiment of the invention is, as mentioned before, characterised by the fact that the grid can change because of different cog sizes in such a way that by different sizes different grain sizes are defined.

It is, of course, also possible that bends run in the same direction, preferably parallel, so that the grid is defined with trapezoidal bent slots.

Another modification of the sieve device according to the invention provides that the bends run staggered to each other so that the slots are designed non-uniform. In this way also a certain grid can be produced and certain sieve tasks can be solved better by it.

Another aspect of the invention is given by the fact that the cogs have chamfers designed running in opposite direction or in the same direction parallel so that the grid is designed like a whole or a snake.

Of course, according to the invention also a sieve device is provided where the cogs are bent or angled alternately.

In order to make conveying of the non-sieved material in the cylinder or in the cylinder disintegrator easier the cogs are bent at their free ends, in particular bent upwards in set-up direction of the cylinder disintegrator.

The cogs of the cog elongation can be shaped from either flat material or rounded material.

It is preferred if the cogs are shaped from spring steel. The cogs may here be in one piece or shaped from spring steel cog elements arranged one above the other in two or more layers.

The distances of the cogs to each other can, according to a development of the invention, change or vary.

The invention also refers to a cylinder disintegrator with a sieve device as described before. An advantageous development of the cylinder disintegrator provides that the cylinder is designed for a rotary frequency of 20 to 100 revolutions per minute, preferably 40 revolutions per minute.

The cogs of the cog elongation are arranged in operating position preferably below the countercogs of the cylinder disintegrator, and furthermore preferably in the gaps between or below the countercogs.

A development of the invention also provides that the cogs of the cog elongation are connected directly with the countercogs of the cylinder disintegrator.

For attaching the cog elongation or the individual cogs of the cog elongation a bearing is provided. This bearing is arranged in the housing of the cylinder disintegrator and is supported preferably swivelling.

According to a development of the invention it is also provided that the bearing can be moved by hydraulic cylinders engaging with the bearing. Thus, on the one hand, it is guaranteed that the cog elongation is each time in an optimal position with regard to the cylinder, and, on the other hand, by means of that also the distance between the cutting tools of the cylinders and the countercogs can be influenced, for example when at the same time the countercogs are attached to the bearing.

Figure 2:
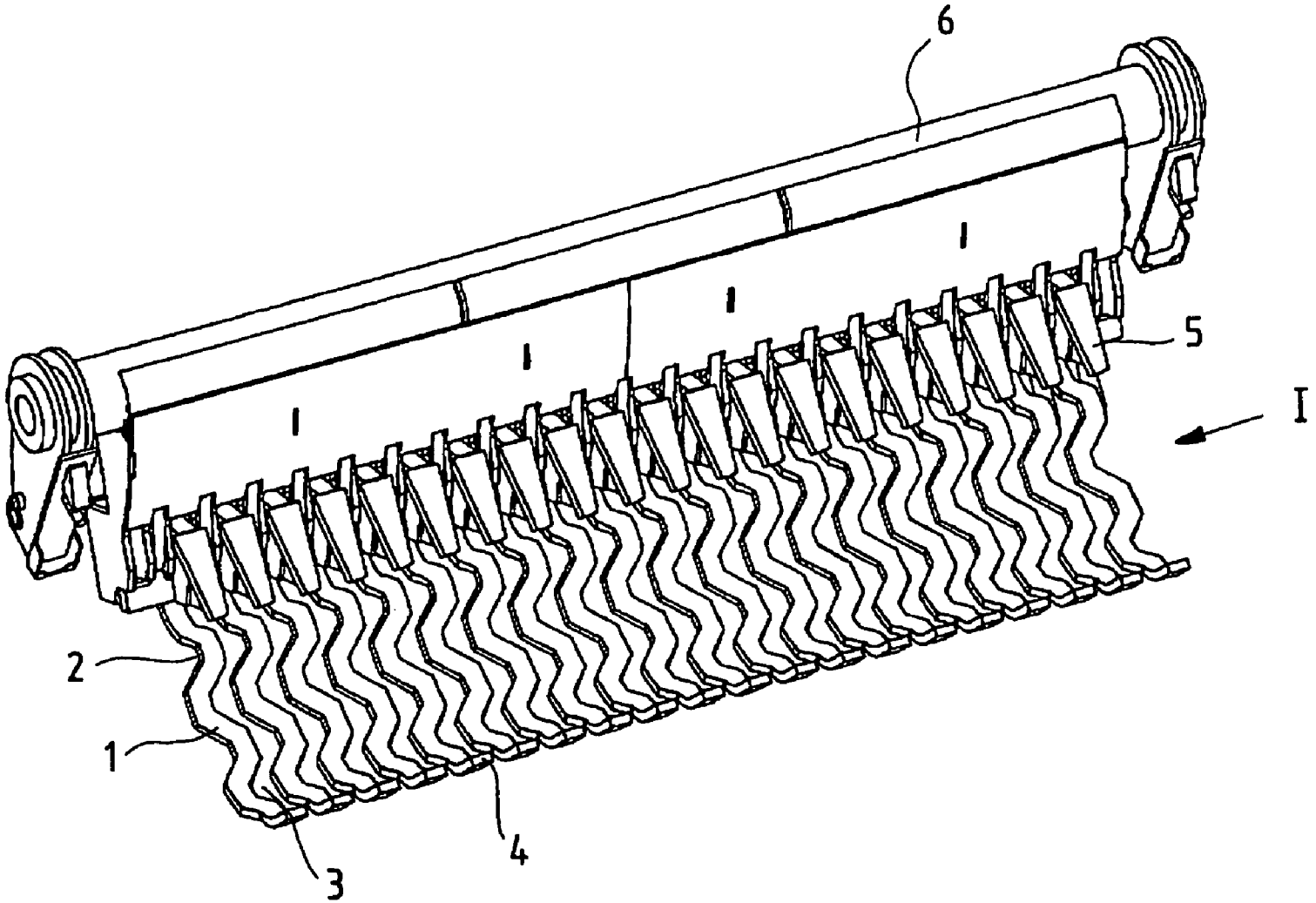

In the following the invention is described by means of examples. In the figures:

FIG. 1 a modification of the invention with honey-combed grid of the cog elongation;

FIG. 2 another embodiment of the invention with trapezoidal bent cogs running in the same direction and FIG. 3 a sieve device known from the state of the art with straight cogs.

FIG. 1 shows an embodiment of the invention with honey-combed grid 3 of the cog elongation I. The cogs 1 are bent trapezoidal running in opposite direction to each other so that the result is a honey-combed grid 3. The bends are indicated by reference number 2. By means of the arrangement of the cogs 1 bent trapezoidal in opposite direction the grid 3 is formed. Above the grid 3 or the gaps between the individual cogs 1 the countercogs 5 of the cylinder disintegrator, which is not shown, are illustrated. These countercogs 5 interact with the cutting tools arranged on the cylinder in such a way that the cutting tools reach in the gaps of the countercogs and thus the material conveyed in by the cylinder is comminuted between the cutting tools of the cylinder and the countercogs 5. Reference number 6 indicates the bearing to which the cog elongation I as well as the countercogs 5 are attached. This bearing 6 is supported preferably swivelling or turning, and has receiving points at its two ends with which, for example, hydraulic cylinders can engage in order to move the bearing inclusively countercog 5 and cog elongation I, or to press them so that the cog elongation I or the countercogs 5 remain always in the desired position. Of course, the position also can be changed by means of these hydraulic cylinders, and that effects a change for the graining of the comminuted material. The cogs 1 of the cog elongation I can, for example, be exchanged, so that in the case of a failure or damage of one single cog 1 this cog can be exchanged without any problems. Furthermore, by varying the shape of the cogs 1 and their distance to each other another grid for larger or smaller graining can be reached without problems. Of course, also a complete cog elongation I for the cylinder disintegrator can be stored having a different graining, so that, when the tasks of disintegration change the complete cog elongation I inclusively the bearing 6 and the countercogs 5 can be exchanged.

FIG. 2 shows another embodiment of the invention with trapezoidal bent cogs 1 running in the same direction. By means of this embodiment also a grid 3 is reached which is formed by snake-like gaps between the cogs 1. The other reference numbers have already been presented in FIG. 1 and will not be described again.

FIG. 3 shows a cog elongation I as it is known from the state of the art. The single cogs 1 are formed here straight in such a way that also straight gaps or a grid 3 running parallel in the same direction is the result. The disadvantages of this solution have been described in the beginning. The reference numbers here also indicate technical characteristics so that not all reference numbers are presented again.

The invention has been described by examples. However, the invention is not restricted to that. The claims filed now and to be filed later on together with the application are attempted formulations without prejudice for obtaining a broader protection.

The references in the sub-claims refer to the further embodiment of the subject matter of claim 1 by the characteristics of the respective sub-claim. However, these are not to be understood as a waiver of obtaining an independent protection of the matter for the characteristics of the referred sub-claims. It has also to be taken into consideration that the different designs shown in the figures can be combined among each other or with each other in any way. Combinations of characteristics not shown so far in the figures therefore are seen as also disclosed.

Characteristics only disclosed in the description so far may be claimed in the course of proceedings as being of inventive relevance, for example to distinguish from the sate of the art.

The invention claimed is:

1. A sieve assembly for a disintegration device, said sieve assembly comprising a sieve device including countercogs and elongated cogs, the elongated cogs being shaped from flexible material and being arranged to extend in a parallel direction to each other, the elongated cogs being provided with trapezoidal bends for forming a grid to define a grain size of sieved material between adjacent elongated cogs, and a bearing for the elongated cogs and the countercogs, said bearing directly connecting the elongated cogs and the countercogs at one end of the elongated cogs and the countercogs, the other end of the elongated cogs and the countercogs being free and spaced from the bearing, the bearing turning or swivelling for movement of the elongated cogs and the countercogs to a desired position.

2. The sieve assembly according to claim 1, wherein the trapezoidal bends are bent in opposite direction directions in such a way that the grid is defined as a honey-combed sieve.

3. The sieve assembly according to claim 1, wherein the trapezoidal bends are bent in opposite directions in such a way that the grid is defined as a honey-combed sieve, and the grid changes because of different elongated cog sizes in such a way that by different sizes different grainings are defined.

4. The sieve assembly according to claim 1, wherein the grid is defined by trapezoidal bent slots.

5. The sieve assembly according to claim 4, wherein the trapezoidal bends run staggered to each other so that the slots are formed non-uniformally.

6. The sieve assembly according to claim 1, wherein the elongated cogs have chamfers.

7. The sieve assembly according to claim 1, wherein the elongated cogs are bent or angled alternately.

8. The sieve assembly according to claim 1, wherein the elongated cogs are bent at their free ends upwards.

9. The sieve assembly according to claim 1, wherein the elongated cogs are shaped from flat material.

10. The according to claim 1, wherein the elongated cogs are shaped from rounded material.

11. The sieve assembly according to claim 1, wherein the elongated cogs are shaped from spring steel.

12. The sieve assembly according to claim 1, wherein the elongated cogs are shaped in one piece or from spring steel elongated cog elements arranged one above the other in two or more layers.

13. The sieve assembly according to claim 1, wherein distances of the elongated cogs to each other changes or varies.

14. The sieve assembly according to claim 1, further comprising a cylinder designed for a rotary frequency of 20 to 100 rpm.

15. The sieve assembly according to claim 14, wherein the rotary frequency is 40 rpm.

16. The sieve assembly according to claim 1, wherein in the operation position the elongated cogs are arranged below the countercogs, in the gaps between the countercogs.

17. The sieve assembly according to claim 1, wherein the bearing is moved by hydraulic cylinders engaging with the bearing.

* * * * *